United States Patent [19]

Fromknecht

[11] 4,124,916

[45] Nov. 14, 1978

[54] VACUUM CLEANER CONDITION INDICATOR AND SAFETY DEVICE

[75] Inventor: Charles T. Fromknecht, Anderson, S.C.

[73] Assignee: The Singer Company, Elizabeth, N.J.

[21] Appl. No.: 821,878

[22] Filed: Aug. 4, 1977

[51] Int. Cl.[2] ..... A47L 9/00

[52] U.S. Cl. ..... 15/339; 55/274; 55/DIG. 34; 116/114 AD

[58] Field of Search ..... 15/339; 55/274, DIG. 34; 116/114 AD

[56] References Cited

U.S. PATENT DOCUMENTS

| | | | |
|---|---|---|---|
| 1,959,759 | 5/1934 | Hultberg | 55/211 |
| 2,192,224 | 3/1940 | Forsberg | 55/211 |
| 2,203,171 | 6/1940 | Martinet | 15/339 |
| 2,741,328 | 4/1956 | Cawl | 55/211 |
| 3,177,635 | 4/1965 | Cawl et al. | 55/274 |
| 3,232,030 | 2/1966 | Owenmark | 55/274 X |
| 3,678,882 | 7/1972 | Kinsella et al. | 15/339 X |
| 4,020,525 | 5/1977 | Fromknecht et al. | 15/339 |

*Primary Examiner*—Christopher K. Moore
*Attorney, Agent, or Firm*—Robert E. Smith; Edward L. Bell; Alan Ruderman

[57] ABSTRACT

A vacuum cleaner detector that indicates when the hose is clogged and bleeds in cooling air to the vacuum chamber so as to prevent overheating of the motor blower. The indicator comprises an actuator valve and a relief valve. The actuator valve includes a pressure responsive member having filter bag compartment pressure applied to one side thereof and atmospheric pressure applied to the other side. When the absolute pressure within the filter bag chamber drops, the pressure responsive member is moved toward the low pressure side moving a plunger which opens a port when the pressure drops below that desired to allow filter bag chamber pressure to vent to the low pressure side of a pressure responsive member in the relief valve. The other side of the relief valve pressure responsive member is acted upon by atmospheric pressure which thereby forces the pressure responsive member away from a bleed hole to allow atmospheric pressure to flow into the filter bag chamber to insure that the motor blower has sufficient air flow for cooling, and simultaneously the pressure responsive member forces an indicator button out of the cleaner. Also disclosed is a vacuum cleaner filter bag condition indicator that detects when the bag is substantially full and should be replaced. The use of the two indicators together allows the determination of whether the filter bag is full or whether the hose is clogged.

6 Claims, 6 Drawing Figures

VACUUM CLEANER CONDITION INDICATOR AND SAFETY DEVICE

BACKGROUND OF THE INVENTION

This invention relates to vacuum cleaners and more particularly to an indicator for detecting when a clogged condition exists in the intake air passage of a vacuum cleaner and for bleeding ambient air into the suction chamber when such a condition exists for cooling the suction creating motor blower to prevent failure by overheating.

During the operation of a vacuum cleaner, dirt laden air is drawn into the cleaner inlet, directed through a dirt collecting filter bag and clean filtered air is exhausted through an outlet. In U.S. Pat. No. 4,020,525, an indicator for detecting when the dirt collecting filter bag is effectively full and should be changed is disclosed. In that system, the pressure drop across the filter bag is monitored to signal the operator to change bags. As the bag fills, the pressure in the bag increases (suction decreases) and the pressure in the bag chamber decreases (suction increases). In many cases, however, it has been found that the operator of the cleaner ignores the bag change indicator. The continued use of the cleaner under these conditions can result in excessive motor overheating. The high resulting temperatures has in certain cases caused the cleaner housing to structurally weaken, and due to the low pressures within the housing to plastically deform. Further operation of the cleaner may create an excessively hazardous situation. Moreover, some objects that may be picked up by the cleaning tool at the end of the hose may be such as to wedge in and cause a clogging of the hose. When this occurs, the bag condition indicator will not actuate unless the clogging is at the mouth of the bag. In either event, however, merely changing the bag will not alleviate the condition. The operator needs more information to locate the problem which if not corrected can cause overheating of the motor and result in the above described conditions.

SUMMARY OF THE INVENTION

In order to overcome these problems, the present invention provides an apparatus for detecting the existence of a clogged condition in the intake air path of a vacuum cleaner and for bleeding room air into the suction chamber of the cleaner to maintain a flow of cooling air to the motor to prevent overheating thereof. Preferably, the detector includes a visual indicator. Used in conjunction with a bag condition indicator, the clogged condition indicator provides the operator with the means to rapidly determine the cause of a low pressure, but in the event the operator ignores the condition indicators, the bleed air prevents overheating of the motor.

Consequently, it is the primary object of this invention to provide a vacuum cleaner safety device for detecting the existence of a clogged condition in the intake air path and to bleed ambient air into the filter bag compartment to prevent overheating of the electric motor.

It is another object of the present invention to provide a vacuum cleaner with an indicator for detecting a clogged hose condition and for dumping ambient air into the filter bag compartment.

A further object of this invention is to provide a vacuum cleaner having indicators for detecting the cause of a low pressure low air flow condition and for preventing damage to the cleaner from failure to quickly shut the unit down.

In carrying out the objects of the invention an actuator is provided to sense the difference between atmospheric room pressure and filter bag chamber pressure and when this exceeds a predetermined value indicating that bag chamber pressure and when this exeeds a predetermined value indicating that bag chamber absolute pressure has dropped below a desired value, i.e., when the vacuum within the chamber has increased to a point indicating a very low quantity of air is flowing, the actuator vents the low bag chamber pressure to the low pressure side of a pressure responsive member of a relief valve having atmospheric room air acting on the other side thereof. The pressure responsive member is thereby immediately forced to the low pressure side opening a bleed hole in the floor of the filter bag chamber to bleed atmospheric air from the room into the bag chamber. Preferably, when this occurs, an indicator is simultaneously driven out of the cleaner body to signal the operator to shut off the cleaner.

As the filter bag fills with dirt the vacuum in the bag chamber increases, i.e., the absolute pressure decreases, and the absolute pressure at the inlet to the bag increases. Thus, the pressure drop across the bag increases. At the point where the cleaning efficiency drops so that the bag should be replaced an indicator such as that forming the subject matter of the aforesaid U.S. Pat. No. 4,020,525 will inform the operator. If, however, the operator ignores this signal, or if the hose is clogged with debris the bag chamber absolute pressure will decrease further until the actuator will vent bag chamber pressure to relief valve causing it to bleed air from the room into the bag chamber and to signal the low pressure condition.

In practicing the teachings of this invention as in the preferred embodiment, the actuator may be a valve comprising three chambers, the first and second chambers being separated by a flexible diaphragm, and the second and third chambers being separated by a rigid member. A plunger extends through the rigid member and through the diaphragm and is journaled within an annular boss in the exterior wall of the first chamber. A piston or disk is secured to the plunger in the first chamber and is positioned against the diaphragm. A spring acts against the piston so as to normally maintain the plunger within a hole formed in the bag cover which forms the outer wall of the third chamber. The first chamber is ported to the interior of the filter bag compartment.

The relief valve is separated into two chambers, the first being vented to the third chamber of the actuator valve, and the second being vented to atmosphere. The wall of the second chamber includes a hole which is normally closed by a piston or disk acting on the diaphragm. As the absolute pressure within the bag chamber drops (vacuum increases) the diaphragm in the actuator valve is moved toward the first chamber and when the pressure drops below that desired, the diaphragm causes the plunger to open the hole in the bag cover. This allows bag chamber pressure to vent the third chamber of the actuator and thereby the first chamber of the relief valve. This low pressure in the the relief valve causes the diaphragm to move away from the opening in the second chamber wall causing the bag chamber to vent to the atmospheric room conditions to allow ambient air to rush through the opening to keep the motor blower cool and preferably to force an indicator block out of the cleaner body. When this occurs an indication is thus given either by the audible change due to the flowing air, or by the visible indicator block, that either the bag or the hose is clogged. Used in conjunction with the check bag indicator of U.S. Pat. No. 4,020,525 the present system allows the determination of whether the bag is full or whether the hose is clogged.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
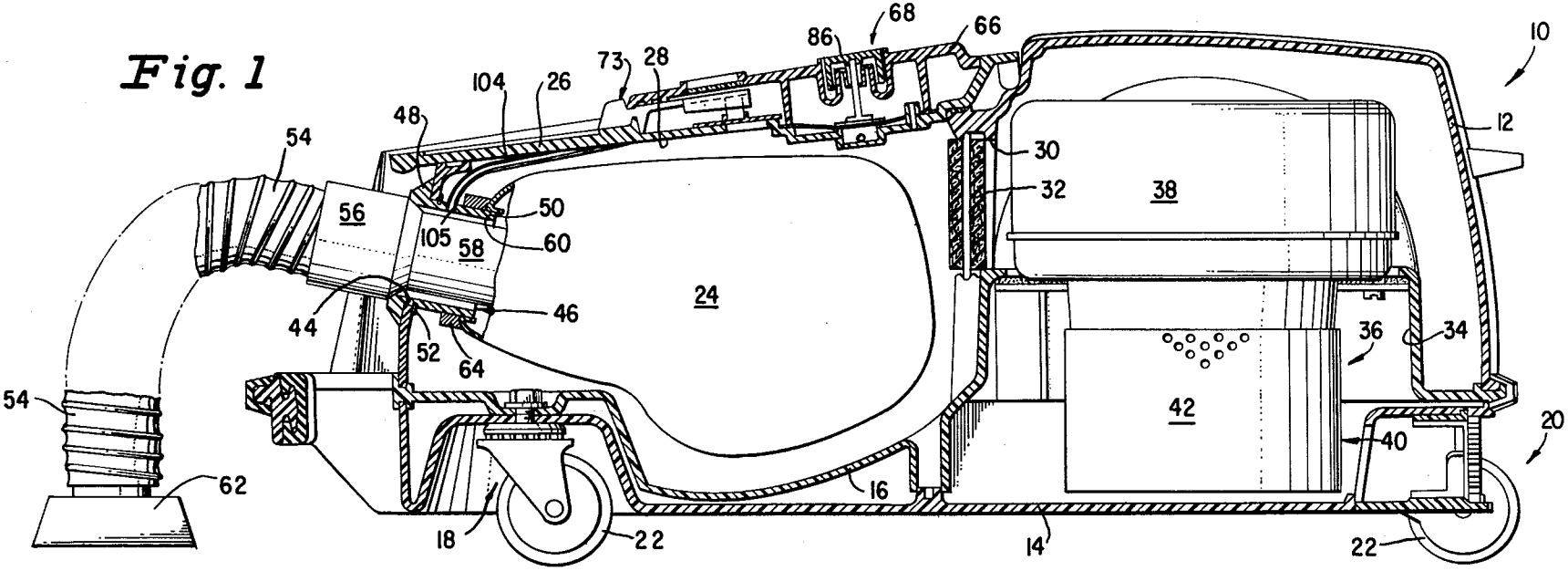
FIG. 1 is a vertical sectional view taken substantially along the longitudinal center line of a vacuum cleaner embodying the detector of the present invention.
Figure 3:
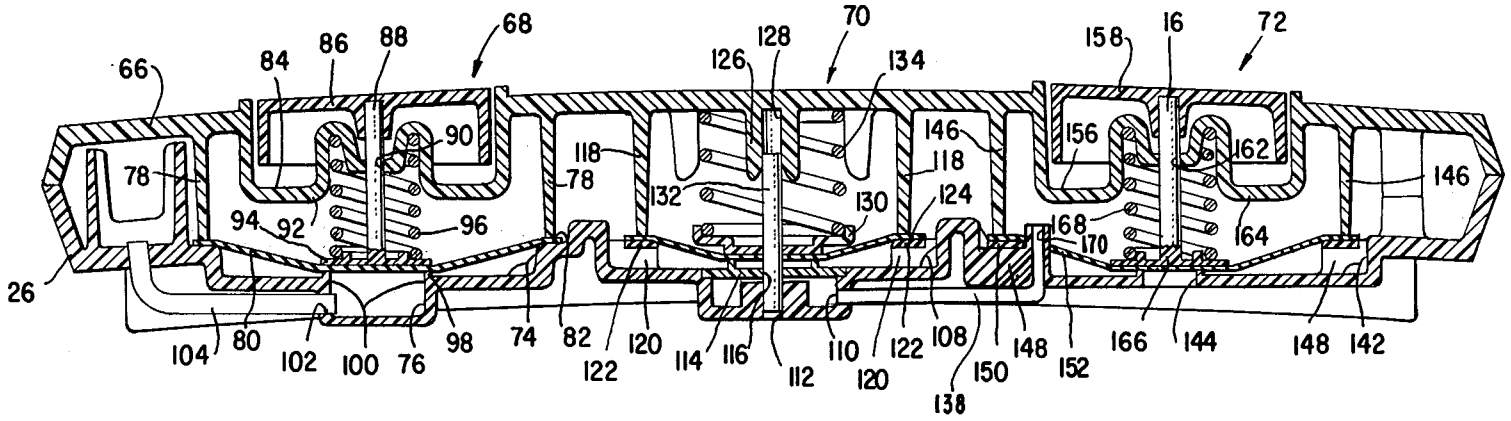
FIG. 3 is a cross sectional view taken substantially along line 3—3 of FIG. 2 illustrating the bag full indicator, and the actuator and relief valve.
Figure 2:
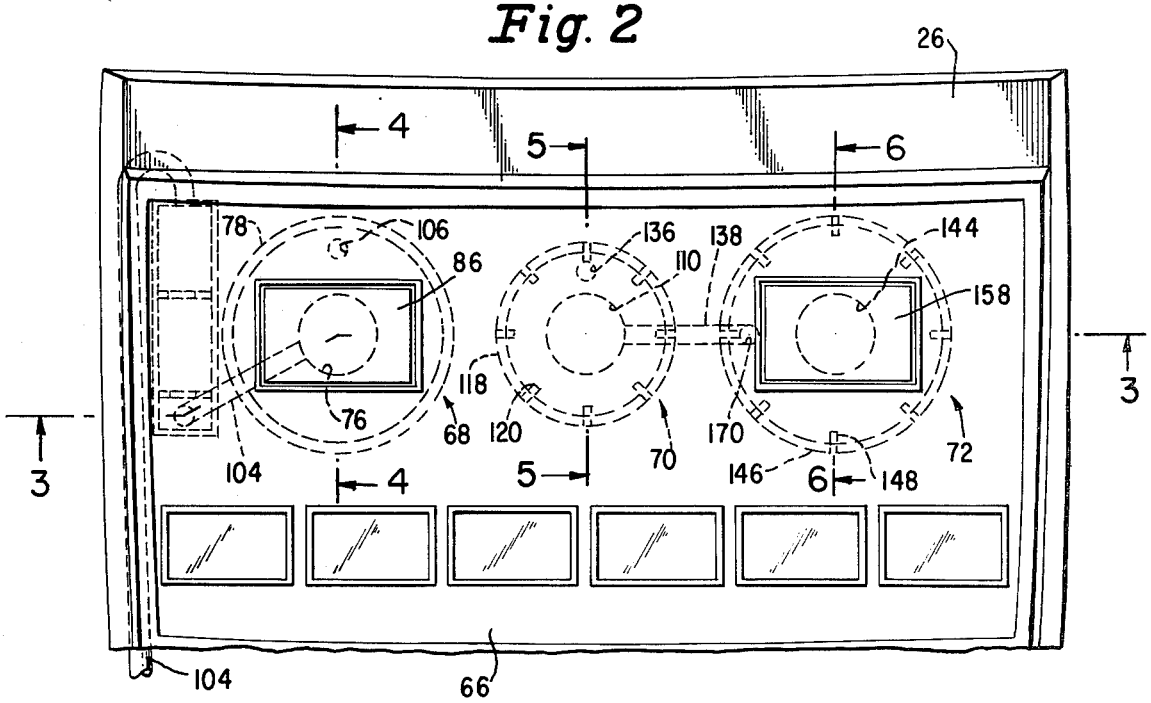
FIG. 2 is a top plan view of the filter bag compartment cover and the indicator housing.
Figure 4:
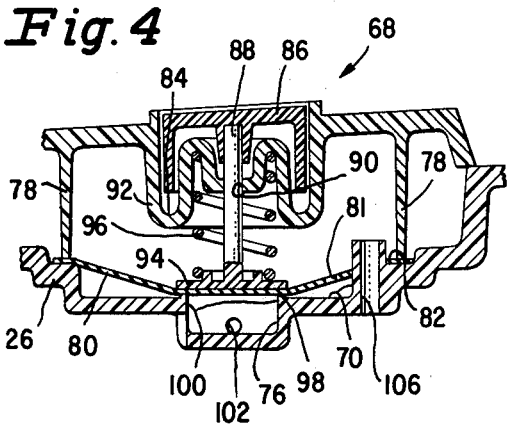
FIG. 4 is a cross sectional view of the filter bag indicator valve taken substantially along line 4—4 of FIG. 2.
Figure 6:
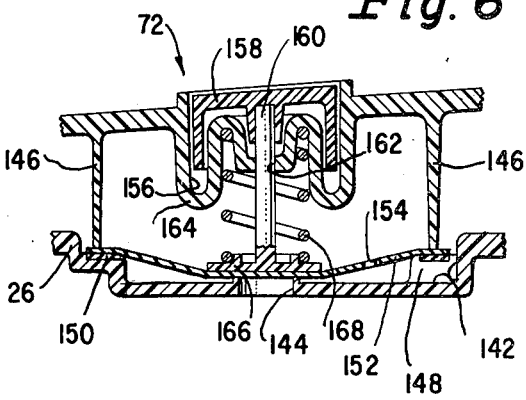
FIG. 6 is a cross sectional view of the check hose indicator/relief valve taken substantially along line 6—6 of FIG. 2.
Figure 5:
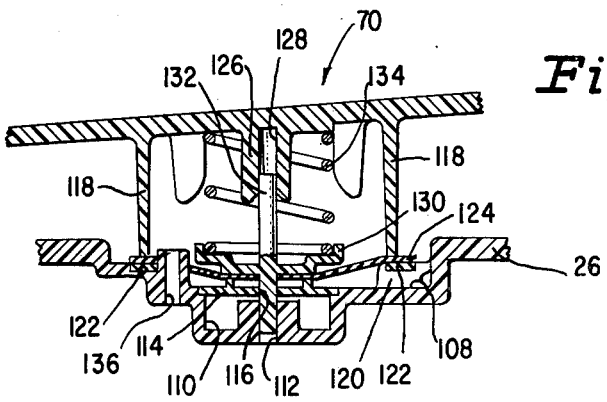
FIG. 5 is a cross sectional view of the actuator taken substantially along line 5—5 of FIG. 2.

Referring now to the accompanying drawings wherein like reference numerals denote similar parts throughout the several views, there is disclosed a canister vacuum cleaner 10 comprising a frame having an upper housing 12, a lower housing 14, and a bulkhead or intermediate housing 16 trapped between the upper and lower housings in sandwich-like relationship. The three housings are fitted together and secured by conventional means. Front and rear wheel assemblies 18 and 20 which includes wheels 22 to allow manipulation of the cleaner aid in securing the lower housing 14 to the bulkhead 16. For a more thorough description of the cleaner, reference may be made to Batson, et al., U.S. Pat. No. 3,668,842 assigned to the assignee of the present application.

A vacuum compartment within which is located a porous air permeable filter bag 24 is formed by the walls of the bulkhead 16, the upper housing 12 and a plastic molded filter bag access door 26 which is fitted over a recessed opening 28 in the upper housing. The door may be shut and latched to provide a substantially airtight seal for the vacuum compartment. Mounted in the vacuum or filter bag compartment in front of a pair of openings 30 formed in a partition wall (not shown) is awashable permanent secondary filter 32 described in Batson, et al., U.S. Pat. No. 3,636,681 assigned to the assignee of the instant application. The bulkhead 16 is formed at the rear thereof with a molded pocket 34 within which is mounted a motor-blower assembly 36 which may be of any suitable standard construction. The air moving or motor-blower assembly 36 preferably comprises a two stage fan unit 38 and a co-axial driving motor unit 40, the motor being cooled by the filtered air flow drawn through the cleaner by the fans. The air enters an inlet opening (not shown) in the top of the fan unit casing and is exhausted at the motor end through a cylindrically shaped motor-blower guard 42 that is formed with exhaust apertures (only some of which are illustrated) in the cylindrical wall and is secured to the motor frame by means, for example, of screws (not shown).

Formed in the front wall of the upper housing is a central opening 44 within which is inserted an intake connector 46 having a flange portion 48 and a cylindrical extension 50. The connector is secured in the upper housing by means of its front flange portion 48 and an annular retaining ring 52 which together lock the connector axially to the upper housing. A hose 54 fitted with a coupling 56 having an adaptor 58 at its other end is connected into a frontal opening 60 of the connector 46. The other end of the hose is adapted to receive one of a plurality of conventional cleaning tool accessories such as 62. The disposable filter bag 24 includes a mounting collar 64 which slips onto the cylindrical extension 50 of the connector 46 and is held thereon by friction so that the dirt and dust in the inlet air stream passing through the hose 54 remains in the bag as the air is drawn through the vacuum or filter bag compartment by the motor-blower assembly.

In accordance with the preferred embodiment of the present invention an indicator housing 66 is secured to the filter bag cover 26 by conventional means such as screws (not illustrated) and as hereinafter described forms a portion of the casings of the full bag indicator 68, the actuator valve 70 and the relief valve 72. The front portion of the housing 66 is spaced from the bag cover 26 to define a slot for a suction control device 73 and for entry of atmospheric room air between the housing 66 and the cover 26. The full bag indicator 68 is essentially the same as that described in U.S. Pat. No. 4,020,525. The casing consists of a wall forming a cup-shaped recess 74 formed in the bag cover having a substantially centrally located cylindrical depression 76 stepped down below the surface of the recess 74, and a cylindrical rib 78 extending downwardly from the bottom of the indicator housing 66.

A resilient diaphragm 80 having a pressure balance hole 81 is positioned on the upper surface of the peripheral rim 82 of the wall about the recess 74 and is entrapped against the rim by the rib 78 so as to divide the indicator casing into two chambers. The upper surface of the indicator housing 66 has a recess 84 for receiving an indicator member 86 adapted to extend out the housing when the bag is effectively full. A rod 88 is secured at one end to the bottom of the member 86 and extends through a hole 90 in the central hub portion 92 of the recess 84. A disk-like member 94 is secured to the other end of the rod and is engaged against, and preferably fixed to, the diaphragm 80. A coil spring 96 is positioned about the rod 88 between the underside of the hub 92 and the disk 94 to bias the diaphragm 80 against the annular peripheral rim 98 of the cylindrical depression 76 which defines an orifice 100 opening into the bottom chamber of the indicator.

The orifice 100 communicates with a port 102 in the wall of the cylindrical depression 76 which receives a tube 104 that extends through the space between the cover 26 and the housing 66 and into an opening 105 in the cylindrical extension 50 so as to communicate filter bag internal pressure to the bottom chamber of the indicator. A tube 106 preferably formed integrally with the bag cover 26 communicates the interior of the upper chamber with the vacuum or filter bag compartment pressure. Thus, as explained in the aforesaid U.S. Pat. No. 4,020,525, when the filter bag becomes full the pressure differential across the diaphragm 80 forces the indicator member 86 out the cleaner to alert the operator.

The actuator 70 which preferably comprises a three chamber valve also has a casing consisting of the bag cover 26 and the indicator housing 66. A cup-shaped recess 108 is formed in the bag cover and includes a further centrally disposed cup shaped indenture 110 having a central aperture 112. A closure member 114 having a hole 116 is fitted into the upper periphery of the cup 110.

The upper portion of the actuator casing is formed by a annular cylindrical projection or rib 118 extending downwardly from the housing 66 and a plurality of upwardly projecting spaced ribs 120 extending radially about the recess 108. Positioned upon the rib 120 is washer 122 upon which a resilient diaphragm 124 similar to diaphragm [is positioned and held against the washer by the cylindrical rib 118. A boss 126 having a recess 128 extends downwardly from the bottom surface of the indicator housing 66. Positioned on and preferably secured to the diaphragm 126 is disk member 130. A plunger 132 is secured to a central portion of the disk 130 and is aligned to be positioned within the holes 112, 116 and the recess 128. The plunger 132 acts as a valve member to open or close the hole 112 as hereinafter described. Positioned about the boss 126 and the rod 132 is a coil spring 134 that acts between the disk 130 and the indicator housing 66 to bias the diaphragm downwardly and is gradually overcome as the suction compartment pressure drops so that the plunger 132 closes the hole 112 until the suction compartment pressure is below the desirable value. A tube 136 is preferably formed integral with the bag cover to communicate the interior of the chamber formed by the indicator housing 66 including the rib 118 and the diaphragm 124 with the interior of the filter bag compartment. The space formed between the diaphragm 124 and the floor of the recess 108 including the closure member 114 defines a chamber open to atmospheric room air that enters between the housing 66 and the bag cover 26. A third chamber is formed between the recess 110 and the closure member 114 to allow filter bag compartment pressure to vent to the relief valve 72 by means of a conduit 138 connected into an aperture, as hereinafter described, when the suction becomes too great in the bag chamber.

The relief valve 72 preferably comprises a two chamber device having a casing consisting of the bag cover 26 and the indicator housing 66. A cup-shaped recess 142 is formed in the bag cover and includes a bleed hole 144 formed in the central portion of the bottom thereof which opens into the filter bag compartment. The upper portion of the relief valve is formed by a hollow cylindrical rib 146 extending downwardly from the housing 66 and a plurality of upwardly projecting spaced ribs 148 extending radially about the recess 142 of the bag cover. A washer 150 is positioned on the ribs 148 and supports a resilient diaphragm 152 having a pressure balancing hole 154. The diaphragm and washer are held against the ribs 148 by the rib 146 to divide the casing into a top and bottom chamber.

The upper surface of the housing 66 may include a recess 156 preferably for receiving an indicator member 158 similar to member 86 that is adapted to extend out of the cleaner housing when the pressure within the bag chamber drops too low. A rod 160 extends through a hole 162 in the central hub portion 164 of the recess 156 and may be secured at one end to the bottom of the member 158. A disk-like member 166 is secured to the other end of the rod and is engaged against and preferably fixed to the diaphragm 152. A coil spring 168 positioned about the rod 160 between the underside of the hub 164 and the disk 166 bias the diaphragm to close the bleed hole 144. A tube 170, preferably formed integral with the bag cover 26, communicates the tophousing above the diaphragm 152 with the conduit 138. The space between the diaphragm 152 and the floor of the recess 142 defines a chamber open to atmospheric room air that enters between the housing 66 and the bag cover 26.

In operation when the filter bag is effectively full, the pressure drop across the filter bag, i.e., between the bag chamber pressure, as detected above the diaphragm 80 via the tube 106, and the filter bag inlet pressure, as detected in the recess 76 via the tube 104, overcomes the bias of the spring 96 and the indicator 86 will be forced out of the cleaner as fully described in the aforesaid U.S. Pat. No. 4,020,525. Preferably this occurs when the pressure differential is approximately 40 inches of water across the bag. However, if the operator ignores this indication of a low air flow condition, the absolute pressure in the bag chamber will continue to drop until the bag chamber pressure drops such that there is a pressure differential between atmospheric room and bag compartment pressure of approximately 54 inches of water. At this time the diaphragm 124 has moved to a point such that the plunger 132 is withdrawn out of the hole 112 to allow the low bag pressure to vent the recess 110 and vent through tube 138 to the upper side of the diaphragm 152. The pressure difference across this diaphragm thereafter effects a compression of the spring 168 to open the bleed hole 144 and allow atmospheric air to rush into the bag chamber. An audible change in the air flow is readily apparent at this time to inform the operator of the condition. However, by providing the indicator 158, this indicator is simultaneously lifted out the cleaner housing when the bleed hole is opened so as to visibly notify the operator. This atmospheric air flow thereafter acts to cool the motor and to stabilize the pressure in the bag chamber to prevent a failure and a possible hazardous condition. The actuator 70 and the relief valve operate in similar fashion when the hose is clogged although in this case the bag indicator will not actuate.

Numerous alterations of the structure herein disclosed will suggest themselves to those skilled in the art. However, it is to be understood that the present disclosure relates to a preferred embodiment of the invention which is for purposes of illustration only and not to be construed as a limitation of the invention. All such modifications which do not depart from the spirit of the invention are intended to be included within the scope of the appended claims.

Having thus described the nature of the invention, what is claimed herein is:

1. In a vacuum cleaner having a housing including a suction compartment, an air permeable filter bag mounted in said compartment, means defining an air inlet in said housing communicating with said filter bag, means defining an outlet in said housing, an air-moving unit in flow communication with said compartment and said outlet for drawing dirt-laden air through said inlet and discharging filtered air through the outlet, the improvement comprising: clog detection means for determining the existence of a predetermined excessively low pressure in said suctin compartment and for bleeding ambient air into said compartment to maintain a sufficient flow of air through said air-moving unit, said detection means comprising pressure responsive means for monitoring the pressure difference between the suction compartment and ambient air, said pressure responsive means including a chamber having a port, a valve normally closing said port and operable to open said port in response to said pressure difference when the pressure in said suction compartment is substantially equal to said predetermined pressure, means defining a bleed hole in said suction compartment, a relief valve normally closing said bleed hold, said relief valve having a pressure responsive member operable to open said hole in response to said pressure difference across said member when the pressure in said suction compartment is substantially equal to said predetermined pressure, means for communicating ambient air to one side of said member, and means for communicating said chamber with the other side of said member, whereby when the pressure in said compartment drops below said predetermined pressure said port is opened and allows said predetermined pressure to vent to said other side of said member to thereby effect opening of said bleed hole.

2. In a vacuum cleaner as recited in claim 1 including an indicator operably secured to said movable with said pressure responsive member, said indicator being supported in said housing and extending externally thereof.

3. In a vacuum having a housing including a suction copartment, an air permeable filter bag mounted in said compartment, means defining an air inlet in said housing communicating with said filter bag, means defining an outlet in said housing, an air-moving unit in flow communication with said compartment and said outlet for drawing dirt-laden air through said inlet and discharging filtered air through the outlet, the improvement comprising: clog detection means for determining the existence of a predetermined excessively low pressure in said suction compartment and for bleeding ambient air into said compartment to maintain a sufficient flow of air through said air-moving unit, said detection means comprising an actuator and a relief valve, said actuator having a casing supported in the housing, pressure responsive means including a movable partition member mounted in and separating said actuator casing into first and second chamber, means communicating said suction compartment with the first chamber, means communicating ambient air to said second chamber, a third chamber associated with said actuator having a portal in communication with the suction compartment, closure means movable with said partition member for normally closing said portal and for opening said portal when the pressure in said suction compartment equals said predetermined pressure, said relief valve having a casing supported in the housing, pressure responsive means including a movable partition member mounted in and separating said valve casing into first and second chambers, means communicating said third chamber of said actuator with the first chamber of said relief valve, means communicating ambient air to the second chamber of said relief valve, the casing of said second chamber of said relief valve having a wall including a bleed hole communicating said second chamber with said suction compartment and normally closed by said partition member, said partition member being movable to open said bleed hole when the pressure in said first chamber of the relief valve equals said predetermined pressure, and means for normally balancing the pressure across said relief valve partition member, whereby upon detection of said low pressure said closure means opens said portal to vent said first chamber of said relief valve of said suction compartment thereby to open said bleed hole to allow ambient air to enter said suction chamber.

4. In a vacuum cleaner as recited in claim 3 wherein said partition member of said relief valve includes an indicator member extending from said casing and movable with said partition member so as to further extend from said casing up actuation of said partition member.

5. In a vacuum cleaner as recited in claim 3 wherein said suction compartment includes an access opening, and a cover for closing said access opening, said actuator and said relief valve casings each comprising a pocket formed in said cover, a roof positioned on said cover, said roof having an annular rib adapted to cooperate with each respective pocket.

6. In a vacuum cleaner as recited in claim 5 wherein said cover includes a plurality of spaced radial ribs about each pocket, each of said partition members being disposed upon respective radial ribs and secured thereon by a respective annular rib, means defining an air conduit between said cover and said roof communicating with ambient air, said radial ribs being in said air path.

* * * * *